US011108183B2

(12) United States Patent
Liao

(10) Patent No.: US 11,108,183 B2
(45) Date of Patent: Aug. 31, 2021

(54) ELECTRICAL CONTACT FOR CONNECTOR

(71) Applicants: FU DING PRECISION COMPONENT (SHEN ZHEN) CO., LTD., Shenzhen (CN); FOXCONN INTERCONNECT TECHNOLOGY LIMITED, Grand Cayman (KY)

(72) Inventor: Fang-Jwu Liao, New Taipei (TW)

(73) Assignees: FUDING PRECISION COMPONENTS (SHENZHEN) CO., LTD., Shenzhen (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/826,299

(22) Filed: Mar. 23, 2020

(65) Prior Publication Data

US 2020/0303856 A1 Sep. 24, 2020

(30) Foreign Application Priority Data

Mar. 22, 2019 (CN) ..... 201920393245.3

(51) Int. Cl.
*H01R 13/24* (2006.01)
*H01R 13/41* (2006.01)

(52) U.S. Cl.
CPC ..... *H01R 13/2457* (2013.01); *H01R 13/41* (2013.01)

(58) Field of Classification Search
CPC ..... H01R 12/52; H01R 13/2435; H01R 13/2492; H01R 13/2457; H01R 13/41; H01R 12/7076
USPC ..... 439/658, 65, 66, 68, 74, 862
See application file for complete search history.

(56) References Cited

U.S. PATENT DOCUMENTS

| | | | | |
|---|---|---|---|---|
| 6,558,182 | B1 * | 5/2003 | Ohkita | H01R 12/57 439/259 |
| 7,435,100 | B2 | 10/2008 | Chang et al. | |
| 7,988,501 | B2 * | 8/2011 | Chang | H05K 7/1069 439/751 |
| 10,326,225 | B2 | 6/2019 | Ju | |
| 2009/0253287 | A1 * | 10/2009 | Polnyi | H01R 13/2457 439/331 |

* cited by examiner

*Primary Examiner* — Travis S Chambers
(74) *Attorney, Agent, or Firm* — Ming Chieh Chang; Wei Te Chung

(57) ABSTRACT

An electrical connector for connecting an electronic package to a printed circuit board, includes an insulative housing with a plurality of passageways therein, and a plurality of contacts are retained in the corresponding passageways, respectively. Each contact has a main body and opposite upper and lower contacting arms extending therefrom in a symmetrical manner in the vertical direction. Each of the upper contacting arm and the lower contacting arm has a pair of spring beams spaced from each other. Each beam includes an extension section directly extending from and coplanar with the main body, an oblique section extending from the extension section and a contacting section extending from the oblique section. The distance between the oblique sections of the pair of beams is essentially same with that of the extension sections thereof, while larger than that of the contacting sections thereof.

19 Claims, 10 Drawing Sheets

ELECTRICAL CONTACT FOR CONNECTOR

BACKGROUND OF THE INVENTION

1. Field of the Invention

The invention relates to the electrical contact for the electrical connector, and particularly to the contact having opposite upper and lower contacting arms each having a pair of spring arms having a reduced distance at the corresponding contacting sections compared with the main bodies thereof.

2. Description of Related Arts

The multiple point contacting is desired between the contact of the connector and the conductive pad of the electronic package. Generally speaking, the dual-beam structure of the contacting arm, i.e., the pair of beams transversely spaced from each other and simultaneously extending from a same retaining plate of the contact, is popularly used in the industry. Anyhow, each beam is so tiny and the space/gap between the pair of beams is also tiny, so that the strength of the pair of beams is questionable.

Hence, an electrical contact with the reinforced dual-beam structure of the contacting arm, is desired.

SUMMARY OF THE INVENTION

To achieve the above object, an electrical connector for connecting an electronic package to a printed circuit board, includes an insulative housing with a plurality of passageways therein, and a plurality of contacts are retained in the corresponding passageways, respectively. Each contact has a main body and opposite upper and lower contacting arms extending therefrom in a symmetrical manner in the vertical direction. Each of the upper contacting arm and the lower contacting arm has a pair of spring beams spaced from each other. Each beam includes an extension section directly extending from and coplanar with the main body, an oblique section extending from the extension section and a contacting section extending from the oblique section. The distance between the oblique sections of the pair of beams is essentially same with that of the extension sections thereof, while larger than that of the contacting sections thereof.

Other advantages and novel features of the invention will become more apparent from the following detailed description of the present embodiment when taken in conjunction with the accompanying drawings.

DETAILED DESCRIPTION OF THE PREFERRED EMBODIMENT

Figure 1:
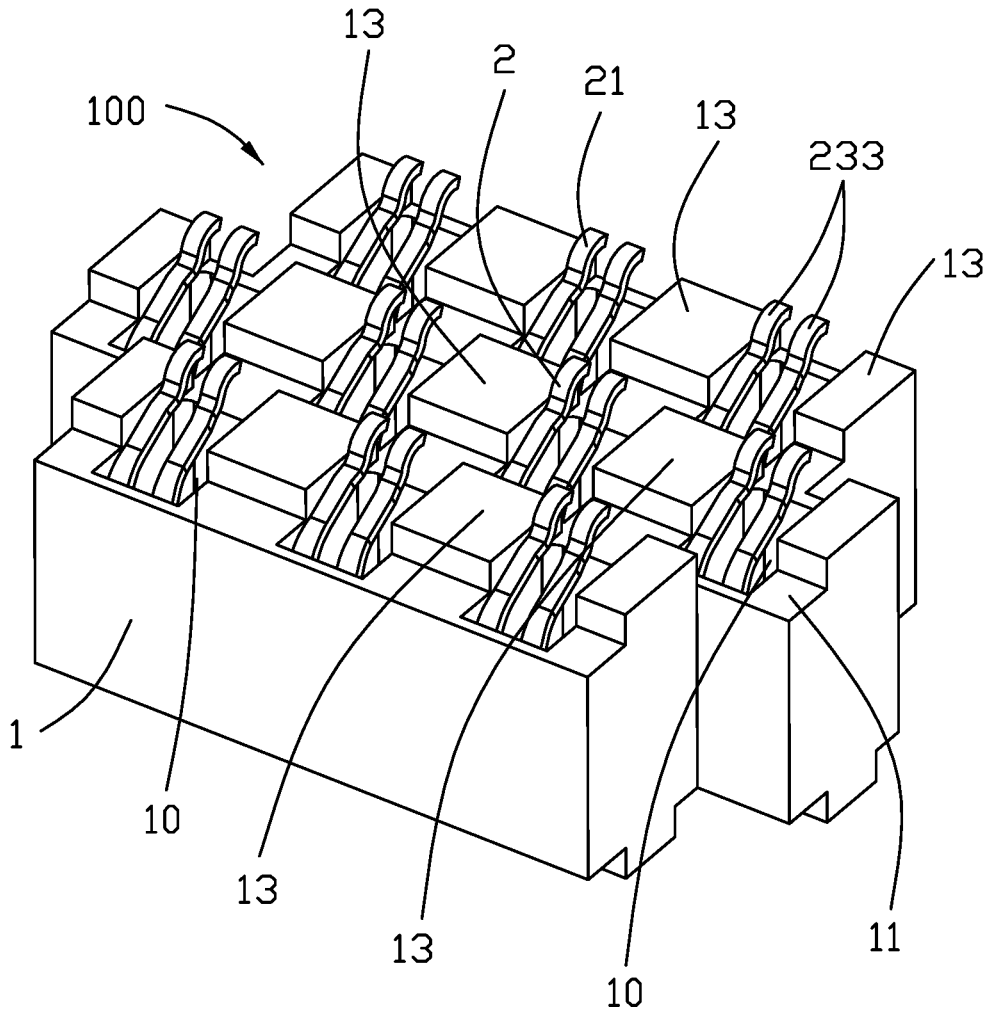
FIG. 1 is a perspective view of the electrical connector according to the present invention.
Figure 2:
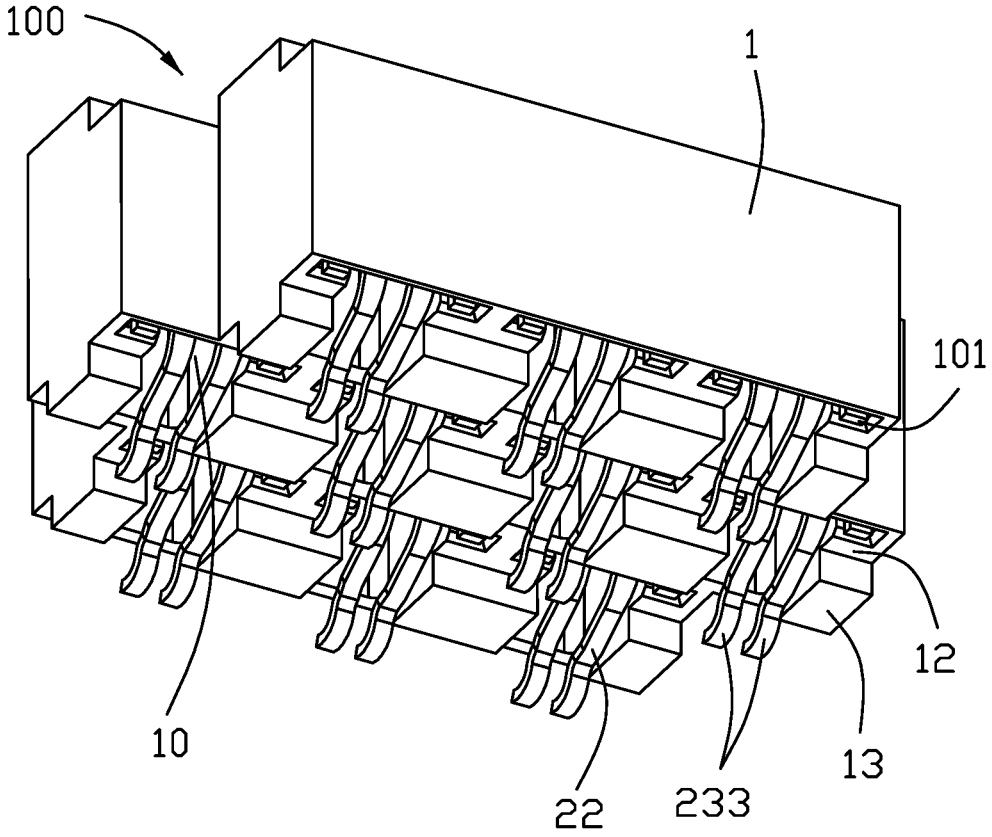
FIG. 2 is another perspective view of the electrical connector of FIG. 1.
Figure 3:
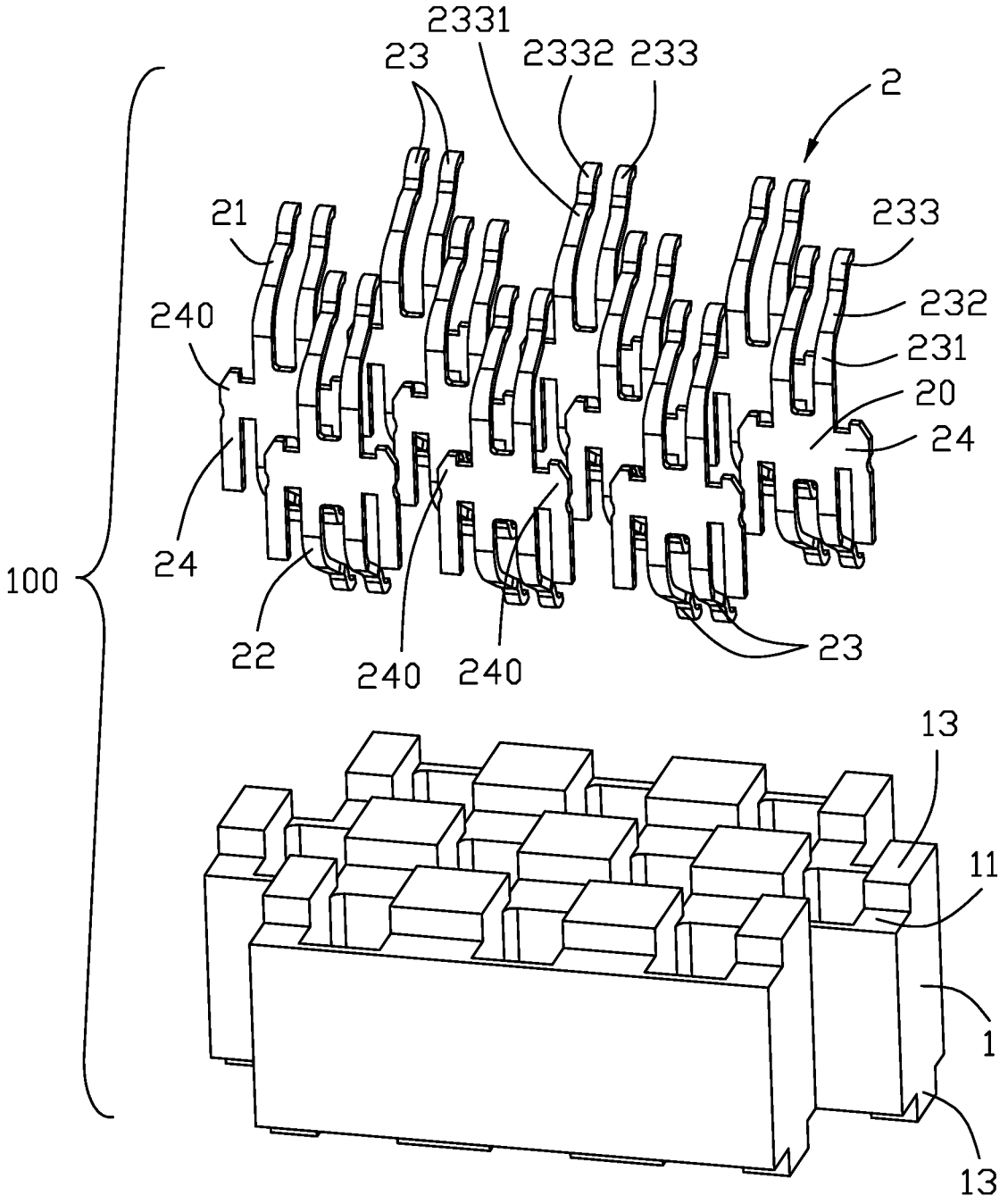
FIG. 3 is an exploded perspective view of the electrical connector of FIG. 1.
Figure 4:
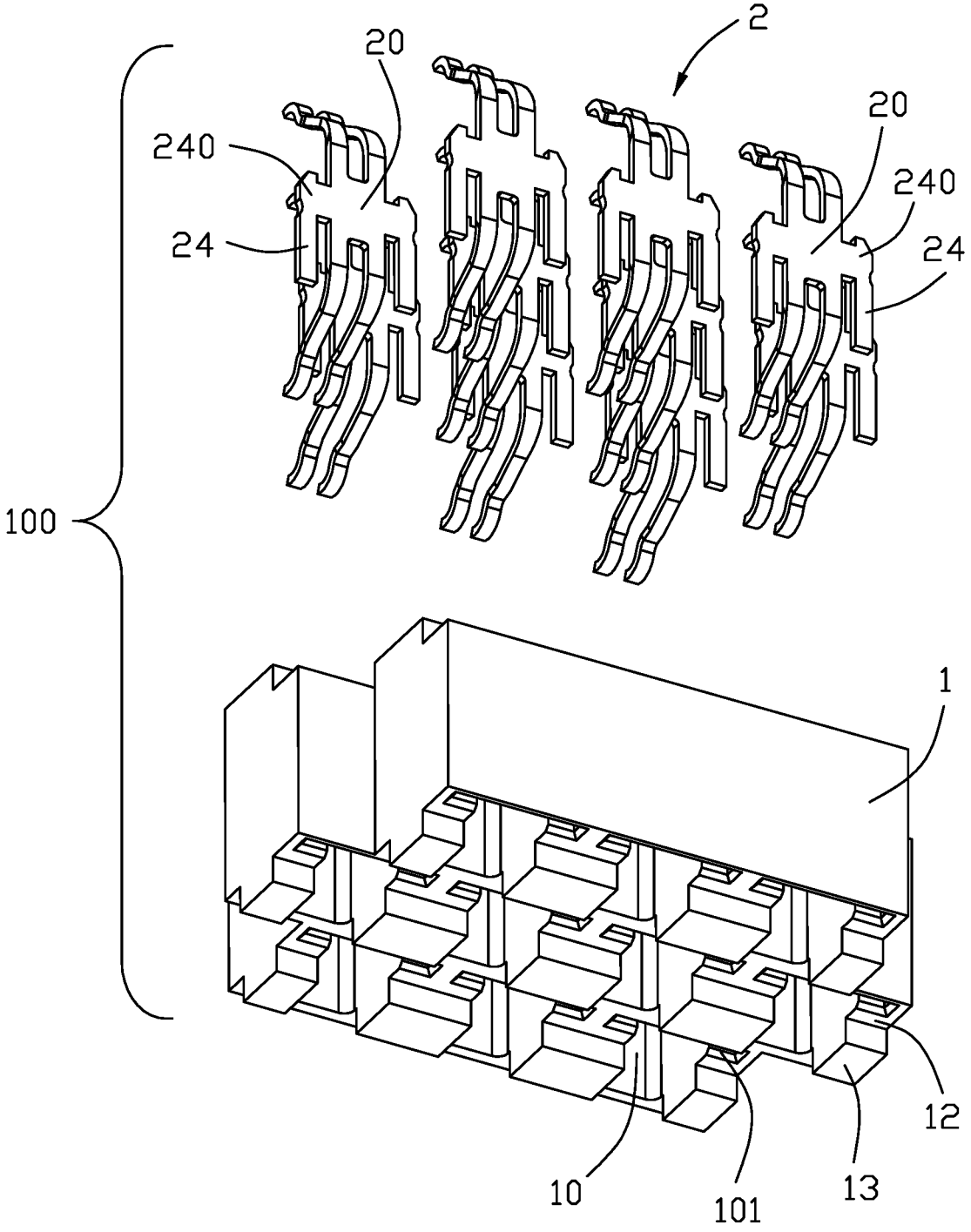
FIG. 4 is another exploded perspective view of the electrical connector of FIG. 3.
Figure 5:
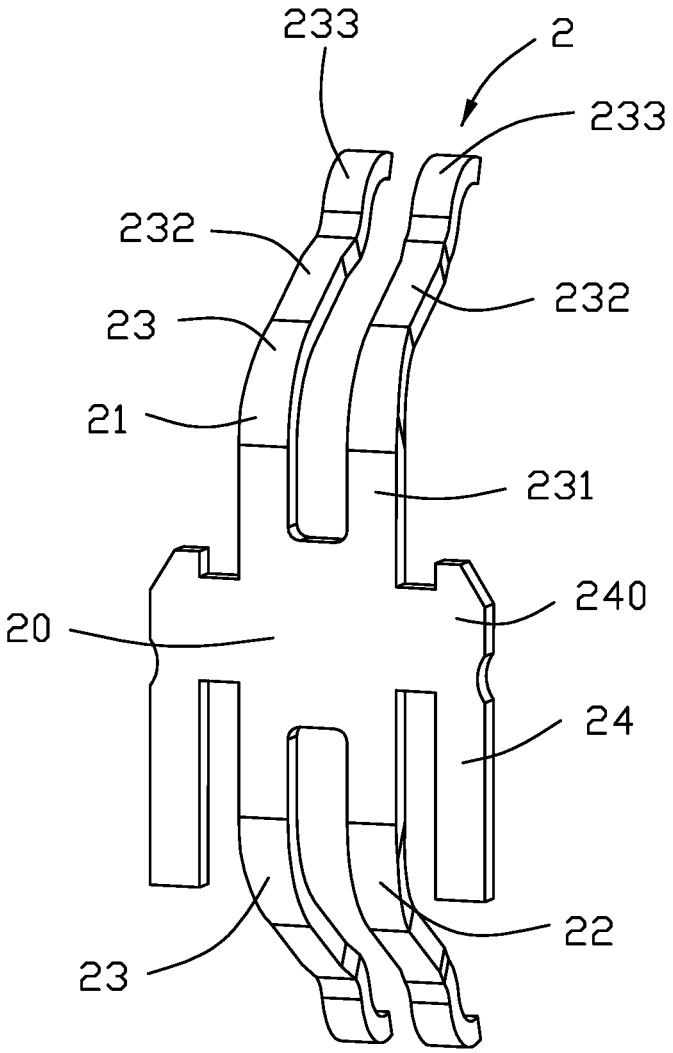
FIG. 5 is a perspective view of the electrical contact of the electrical connector FIG. 3.
Figure 6:
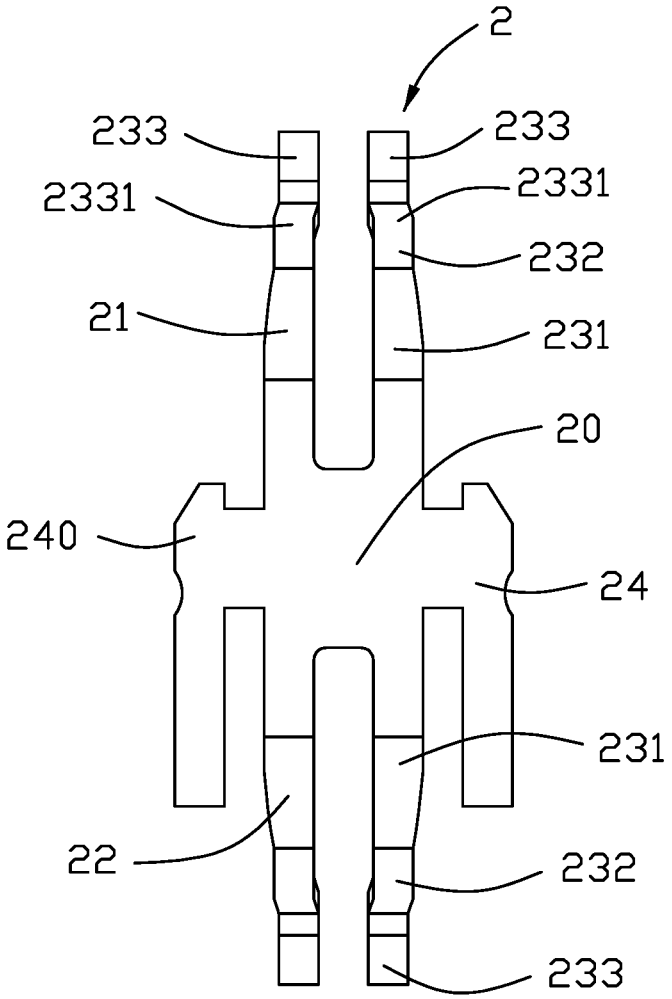
FIG. 6 is an elevational view of the electrical contact of the electrical connector of FIG. 5.
Figure 7:
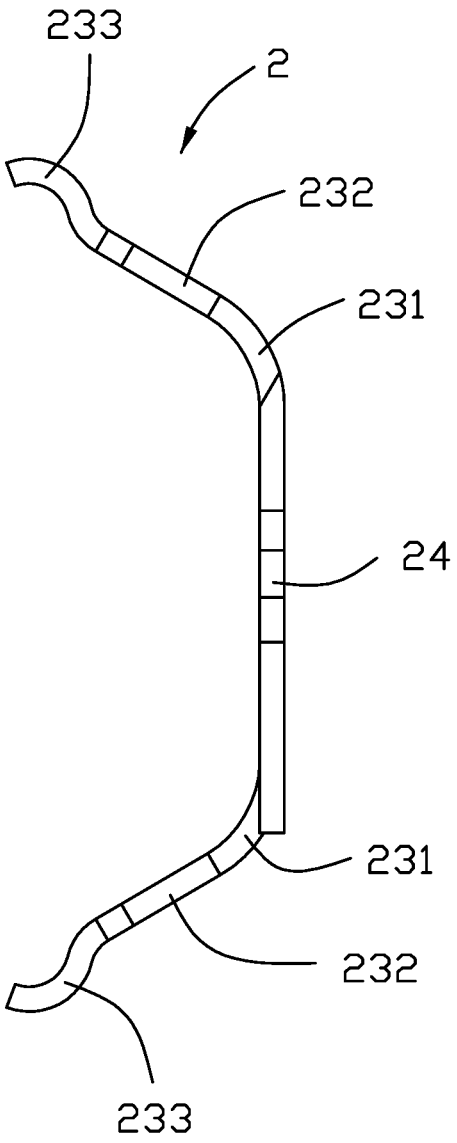
FIG. 7 is a side view of the electrical contact of the electrical connector of FIG. 5.
Figure 8:
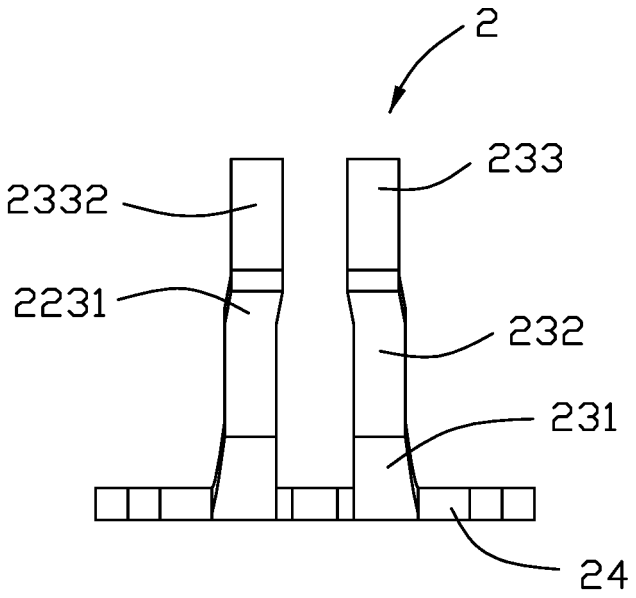
FIG. 8 is a top view of the electrical contact of the electrical connector of FIG. 5.
Figure 9:
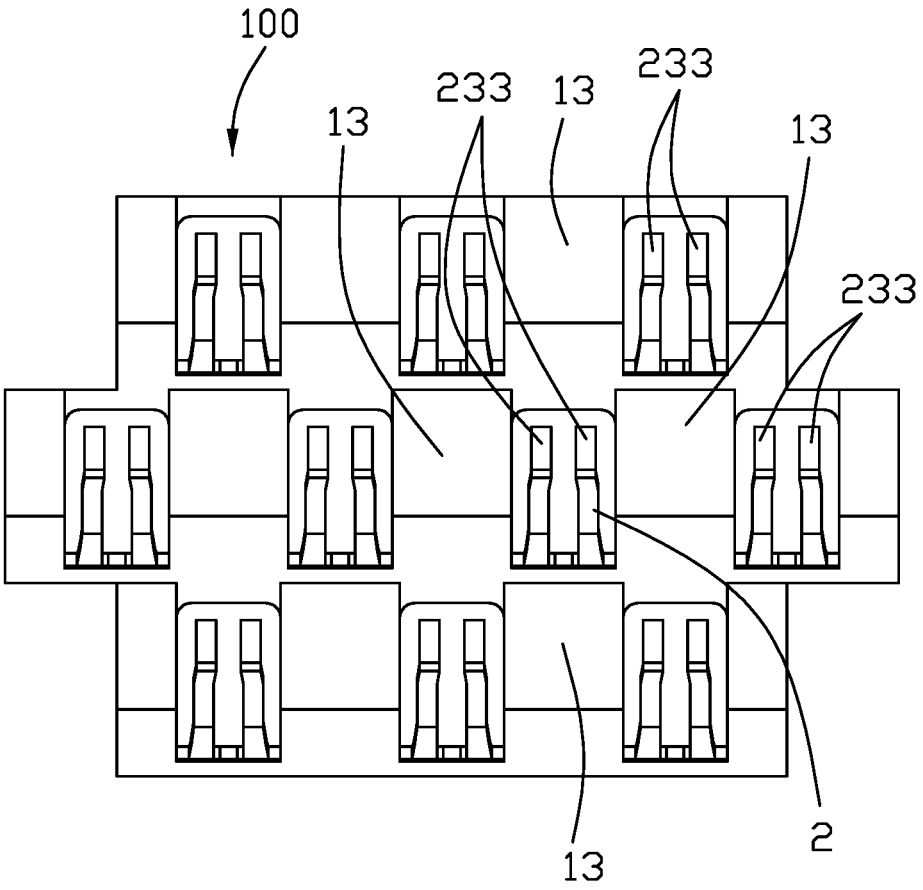
FIG. 9 is a top view of the electrical connector of FIG. 1.
Figure 10:
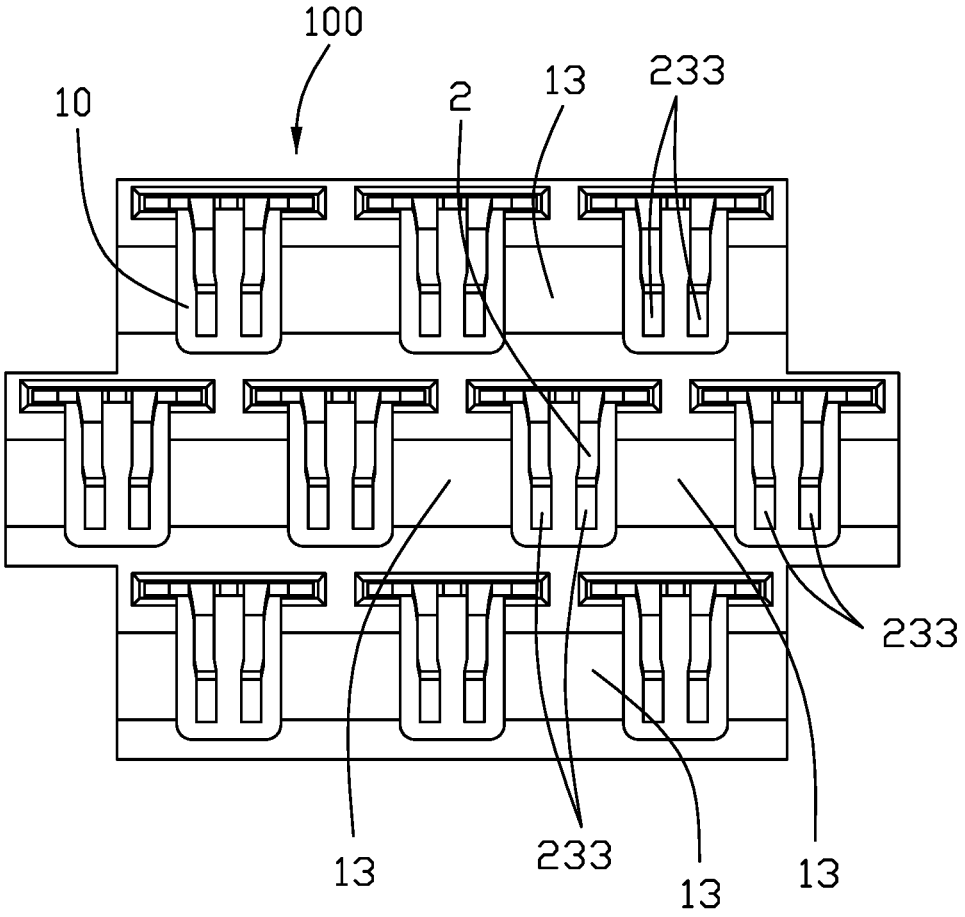
FIG. 10 is a bottom view of the electrical connector of FIG. 1.

Referring to FIGS. 1-10, an electrical connector 100 for connecting an electronic package (not shown) to a printed circuit board (not shown). The connector 100 includes an insulative housing with a plurality of passageways 10 therein, and a plurality of contacts 2 retained in the corresponding passageways 10, respectively. Each contact 2 includes a planar main body 20, and opposite upper contacting arm 21 and lower contacting arm 22 extending from the main body 20 in opposite direction in the vertical direction. Each of the upper contacting arm 21 and the lower contacting arm 22 includes a pair of spring beams 23 spaced from each other in the transverse direction perpendicular to the vertical direction. Each beam 23 includes an extension section 231 directly extending from the main body 20 in a coplanar manner, an oblique section 232 extending from the extension section 231 in an oblique direction, and a contacting section 233 extending from the oblique section 232. The main body 20 further includes on two lateral sides in the transverse direction a pair of retaining sections 24 with corresponding barbs 240 thereon. The passageway 10 further includes a pair of retaining slots 101 to respectively retaining the corresponding retaining sections 24.

In the pair of spring beams 23, a distance between the oblique sections 232 is larger than that between the contacting sections 233. In detail, the contacting section 233 includes an offset section 2331 joined with the oblique section 232, and a curved/bulged contacting region 2332 extending from the offset section 2331 for contacting the conductive pad of the electronic package (not shown). In this embodiment, the width of the contacting section 233 is essentially same with that of the oblique section 232 while the distance between the contacting sections 233 of the pair of spring arms 23 is smaller than that between the oblique sections 232 thereof due to the offset sections 2331 which extend toward each other. In this embodiment, the distance between the extension sections 231 is essentially same with that between the oblique sections 232.

The housing 1 includes opposite top surface 11 and bottom surface 12 with a plurality of standoffs 13 thereon to surround the corresponding contacts 2, respectively. Understandably, the standoffs 13 are used to have the electronic package and printed circuit board (not shown) seated thereon for preventing over-deflection of the contacting arm 21, 22. Notably, both the contacting sections 233 of the pair of spring arms 23 is expected to abut against the same conductive pad of the electrical package (not shown). Understandably, the positions of the contacting sections 233 are essentially predetermined for complying with the position of the corresponding conductive pad of the electronic package (not shown), and the width of the contacting section 233 is also predetermined by consideration from both the mechanical and electrical viewpoints. Therefore, it is requisitely designed to increase the width of the extension section 231 for enhancing the strength of the spring beam 23. Anyhow, because the distance/gap between the contacting sections 233 is relatively tiny, the manufacturability to stamp the pair of spring arms 23 is deemed difficult if the distance between the corresponding extension sections 231, via which the spring beams 23 are joined with the main body 20, keeps the same. This is the reason why the offset section 2331 is formed to increase the width between the oblique sections 232 and that between the extension sections 231.

As mentioned before, in each pair of spring beams 23, the width of the contacting section 233 is same with that of the oblique section 232 while the distance between the contacting sections 233 is smaller than that between the oblique sections 232. Differently, the width of the distance between the oblique sections 232 is same with that between the extension sections 231 while the width of the oblique section 232 is smaller than that of the extension section 231. In this embodiment, a wedge/tapered structure (not labeled) is formed at the joint between the oblique section 232 and the extension section 231 to increase the width of the extension section 231 compared with the oblique section 232. Clearly, such a tapered structure is formed on an outer side/edge of spring beam 23 while an inner edge of the spring beam 23 keeps straight between the oblique section 232 and the extension section 231.

Actually, in a top view the inner edge of the bulged contacting region of the contacting section 233 extends in front-to-back direction perpendicular to both the vertical direction and the transverse direction, and the inner edge of the oblique section 232 and that of the extension section 231 extend also in the front-to-back direction. Moreover, in a top view the tapered structures of the extension sections 231 in each pair of spring beams 23 extend outwardly away from each other, and the offset sections 2331 thereof also extend outwardly away from each other in the transverse direction.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector comprising:

an insulative housing forming a plurality of passageways extending therethrough in a vertical direction;

a plurality of contacts retained in the corresponding passageways, respectively, each of said contacts including:

a planar main body;

an upper contacting arm and a lower contacting arm oppositely extending from opposite upper and lower ends of the main body in the vertical direction;

each of the upper contacting arm and the lower contacting arm including a pair of spring beams spaced from each other in a transverse direction perpendicular to the vertical direction; and each of the spring beams includes an extension section directly extending from the main body, an oblique section extending from the extension section in an oblique direction in a side view, and a contacting section extending from the oblique section; wherein the contacting section includes a bulged contacting region and an offset section which is joined with the oblique section so as to have the distance between the contacting sections is smaller than that between the oblique sections and that between the extension sections.

2. The electrical connector as claimed in claim 1, wherein in the pair of spring beams, the distance between the oblique sections and that between the extension sections are same with each other.

3. The electrical connector as claimed in claim 1, wherein the main body includes a pair of retaining section on two lateral sides in the transverse direction.

4. The electrical connector as claimed in claim 1, wherein the extension section is coplanar with the main body.

5. The electrical connector as claimed in claim 1, wherein in a same spring arm, a width of the contacting section is same with that of the oblique section while is smaller than that of the extension section.

6. The electrical connector as claimed in claim 5, wherein a tapered structure is formed between the oblique section and the extension section to increase the width of the extension section compared with the oblique section.

7. The electrical connector as claimed in claim 6, wherein the tapered structure is formed on an outer edge of the spring arm while an inner edge thereof keeps straight between the extension section and the oblique section.

8. The electrical connector as claimed in claim 7, wherein the inner edge of the spring beam at the oblique section and the extension section extends in a front-to-back direction perpendicular to both the vertical direction and the transverse direction.

9. The electrical connector as claimed in claim 7, wherein in each pair of spring beams, the tapered structures extend away from each other in the transverse direction, and the offset sections extend away from each other in the transverse direction.

10. An electrical connector comprising:

an insulative housing forming a plurality of passageways extending therethrough in a vertical direction;

a plurality of contacts retained in the corresponding passageways, respectively, each of said contacts including:

a planar main body;

an upper contacting arm extending from an upper end of the main body in the vertical direction, and including a pair of spring beams spaced from each other in a transverse direction perpendicular to the vertical direction; and each of the spring beams includes an extension section directly extending upwardly from the main body, an oblique section extending upwardly from the extension section in an oblique direction in a side view, and a contacting section extending upwardly from the oblique section; wherein the contacting section includes a bulged contacting region and an offset section which is joined with the oblique section so as to have the distance between the contacting sections is smaller than that between the oblique sections and that between the extension sections; wherein the distance between the oblique sections and that between the extension sections are same with each other.

11. The electrical connector as claimed in claim 10, wherein the main body includes a pair of retaining section on two lateral sides in the transverse direction.

12. The electrical connector as claimed in claim 10, wherein the extension section is coplanar with the main body.

13. The electrical connector as claimed in claim 10, wherein in a same spring arm, a width of the contacting section is same with that of the oblique section while is smaller than that of the extension section.

14. The electrical connector as claimed in claim 13, wherein a tapered structure is formed between the oblique section and the extension section to increase the width of the extension section compared with the oblique section.

15. The electrical connector as claimed in claim 14, wherein the tapered structure is formed on an outer edge of the spring arm while an inner edge thereof keeps straight between the extension section and the oblique section.

16. The electrical connector as claimed in claim 15, wherein the inner edge of the spring beam at the oblique section and the extension section extends in a front-to-back direction perpendicular to both the vertical direction and the transverse direction.

17. The electrical connector as claimed in claim 15, wherein in each pair of spring beams, the tapered structures extend away from each other in the transverse direction, and the offset sections extend away from each other in the transverse direction.

18. A contact for use within an electrical connector for connecting an electronic package having conductive pads thereon, including:

a planar main body;

an upper contacting arm extending from an upper end of the main body in the vertical direction, and including a pair of spring beams spaced from each other in a transverse direction perpendicular to the vertical direction; and each of the spring beams includes an extension section directly extending upwardly from the main body in a coplanar manner, an oblique section extending upwardly from the extension section in an oblique direction in a side view, and a contacting section extending upwardly from the oblique section; wherein the contacting section includes a bulged contacting region and an offset section which is joined with the oblique section so as to have the distance between the contacting sections is smaller than that between the oblique sections and that between the extension sections.

19. The contact as claimed in claim 18, wherein an inner edge of the spring beam keeps straight between the extension section and the oblique section and extends in a front-to-back direction perpendicular to both the vertical direction and the transverse direction while an outer edge of the spring beam includes a tapered structure between the extension section and the oblique section for increasing a width of the extension section compared with the oblique section, and wherein a width of the contacting section is same with that of the oblique section.

* * * * *